United States Patent [19]

Chacornac

[11] 4,228,605

[45] Oct. 21, 1980

[54] ADJUSTABLE COUPLING APPARATUS FOR SUPERPOSED BARRELS OF A SPORTING GUN OR THE LIKE

[75] Inventor: Georges Chacornac, Saint-Etienne, France

[73] Assignee: Manufacture Francaise d'Armes et Cycles de Saint-Etienne Manufrance S.A., St. Etienne, France

[21] Appl. No.: 909,658

[22] Filed: May 25, 1978

[30] Foreign Application Priority Data

May 27, 1977 [FR] France ..... 77 16935

[51] Int. Cl.[3] ..... F41C 21/06

[52] U.S. Cl. ..... 42/1 R; 42/1 S; 42/76 R

[58] Field of Search ..... 42/75 A, 75 B, 76 R, 42/1 S, 1 R

[56] References Cited

U.S. PATENT DOCUMENTS

| | | | |
|---|---|---|---|
| 1,137,477 | 4/1915 | Godshalk | 42/76 R |
| 1,582,063 | 4/1926 | McIntosh | 42/1 S |
| 3,353,291 | 11/1967 | Musser | 42/1 S |
| 3,550,300 | 12/1970 | Roder | 42/76 R |
| 3,955,299 | 5/1976 | Bullis | 42/76 R |
| 4,094,086 | 6/1978 | Gevers | 42/1 R |

FOREIGN PATENT DOCUMENTS

| | | |
|---|---|---|
| 2031542 | 12/1971 | Fed. Rep. of Germany . |
| 1553852 | 8/1972 | Fed. Rep. of Germany . |

*Primary Examiner*—Charles T. Jordan

*Attorney, Agent, or Firm*—Haseltine, Lake & Waters

[57] ABSTRACT

An adjustable coupling apparatus for first and second spaced superposed barrels of a sporting gun in which the barrels are secured at the rear ends thereof, to a mounting at the stock of the gun, the barrels projecting freely forward therefrom. The barrels are supported at the front ends thereof by a double collar which is fixedly engaged to the upper barrel and is slidably engaged with the lower barrel and holds the barrels in transversely spaced relation while permitting relative axial movement therebetween. A coupling device engages the barrels at an intermediate location along the length thereof for transverse adjustment of the spacing therebetween. The coupling device includes a rotatable wheel which can be rotated in opposite directions to increase or decrease the transverse spacing between the barrels. A detachable and interchangeable sight band is disposed above the upper barrel and is secured at its rear end to the mounting. The sight band is slidably mounted on the double collar and on the coupling device to permit free slidable movement thereof relative to the sight band which remains fixed.

12 Claims, 10 Drawing Figures

ADJUSTABLE COUPLING APPARATUS FOR SUPERPOSED BARRELS OF A SPORTING GUN OR THE LIKE

FIELD OF THE INVENTION

This invention relates to the sporting-guns of the type having superposed barrels.

PRIOR ART

It is well known, in guns with superposed barrels, that the tubes of the barrels are rigidly fastened together over their entire length by means of a single sectional wedge or spacer, or by means of lateral bands that are drilled or not, in order to ensure a convergence of the axes of said tubes.

In practice, and according to the choice of the user, the tubes of the barrels are not fired regularly in turn, particularly in the case of a shooting contest, and the barrel fired more often is distorted longitudinally and radially while being restrained by the opposite barrel, due to the stiffness of the connection.

Therefore, the general and accurate characteristics of the original adjustment for the aim of the barrel tubes are altered, thereby modifying the shooting trajectories and impairing the accuracy.

SUMMARY OF THE INVENTION

In order to obviate these disadvantages, an object of the invention is to provide an adjustable coupling device for connecting the superposed barrels of sporting-guns or other firearms.

According to a first feature of the invention, the barrel tubes are disposed in parallel and are connected at their front ends by a double collar integral with the upper barrel and slidingly mounted on the lower barrel in order to permit an axial independent shifting of one barrel relative to the other, said barrels being connected freely by a spacer collar comprising two adjustable parts for moving the barrels away from one another or bringing them closer to one another, and a knurled wheel for adjusting the alignment of the barrels for compensating any independent radial deformation.

According to a further feature, a detachable and interchangeable band is disposed above the upper barrel tube and is secured by a cotter pin to the mounting at the stock, the front end of the band overlapping the upper part of the double collar and engaging by a transverse cotter pin, a longitudinal slot in said collar for permitting free axial sliding of the upper barrel while the band remains stationary.

In accordance with a further feature, the band is of U-shaped cross-section and is held securely by means of clips that are integral with the spacer collar and with a guard that is fixed on the upper barrel.

According to a further feature, the spacer collar for the barrel tubes comprises a ring that is freely slidable on the lower barrel and a threaded journal extends vertically from the ring and has an opening for the engagement of a positioning finger integral with the upper barrel. An upper part of the spacer collar is constituted by an open collar freely slidable on the upper barrel and having side legs straddling the section of the ring, the legs having slots receiving a knurled wheel interposed between the barrel tubes and threaded on the journal so that by rotation of said wheel in either direction the two parts of the collar and therefore the barrels can be moved apart or together, the two parts of the collar being coupled at the side legs by transverse cotter pins forming an abutment preventing separation of these parts while permitting their relative shifting.

According to a further feature, the knurled wheel is provided on the upper face with recesses that are disposed in circular arrangement for co-operating respectively with a spring-loaded positioning ball accommodated in an opening in one of the side legs of the open collar.

In accordance with a further feature, a reference mark is provided on one of the side faces of the ring for co-operating with the end of the side leg of the upper collar for a convenient and visual inspection of the spacing between the barrel tubes.

DETAILED DESCRIPTION

Figure 1:
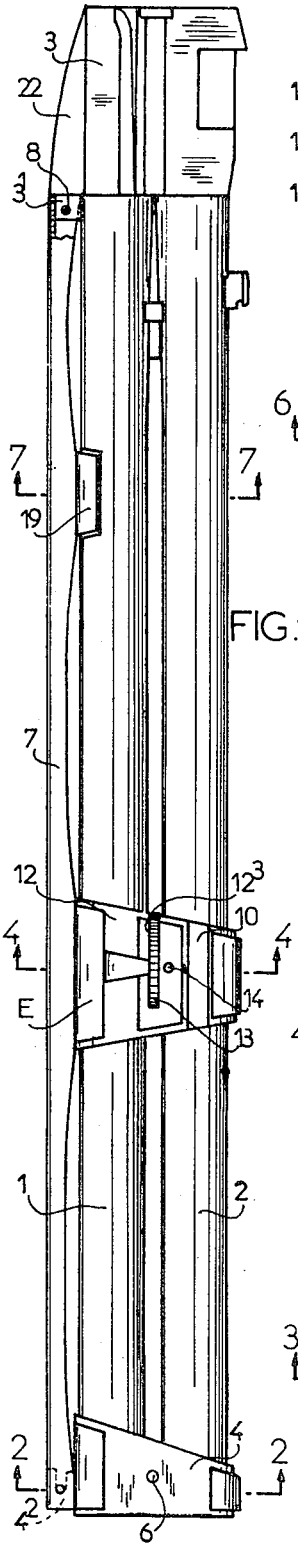
FIG. 1 shows on a reduced scale an external side view of the adjustable connecting and coupling device according is the invention for superposed barrels mounted at their rear ends in a mounting.
Figure 6:
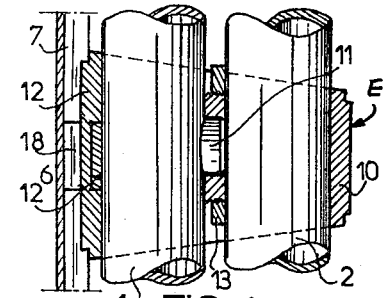
FIG. 6 is a sectional view taken along line 6—6 in FIG. 5.
Figure 9:
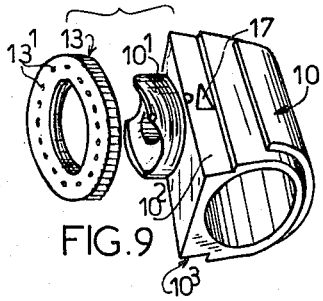
FIG. 9 is a perspective view of a lower ring of a spacer collar of the coupling device and a knurled wheel engageable with the collar.
Figure 5:
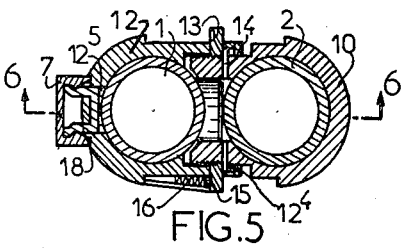
FIG. 5 is a view similar to FIG. 4, but with the barrel tubes at a minimum spacing.
Figure 10:
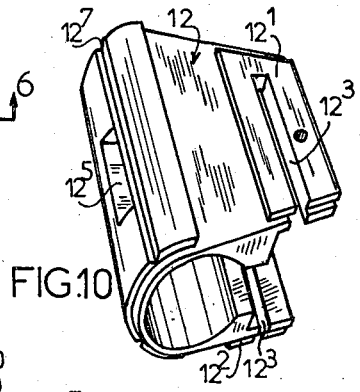
FIG. 10 is a perspective view of the upper part of the spacer collar.
Figure 4:
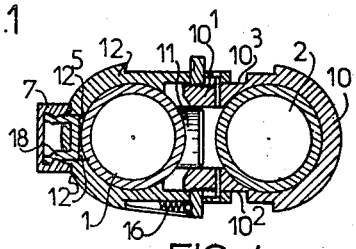
FIG. 4 is a sectional view on a larger scale taken along line 4—4 in FIG. 1, the barrel tubes being shown with maximum spacing.
Figure 8:
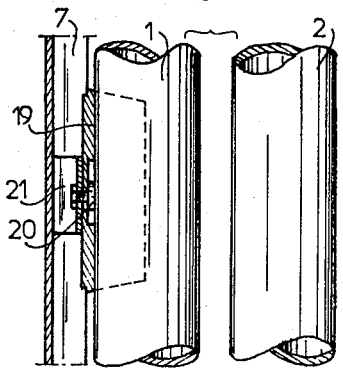
FIG. 8 is a sectional view taken along line 8—8 in FIG. 7.
Figure 3:
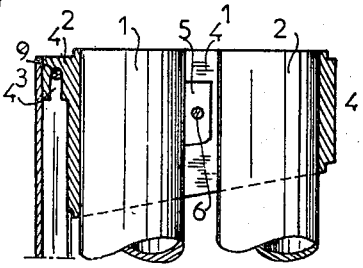
FIG. 3 is a sectional view taken along line 3—3 in FIG. 2.
Figure 7:
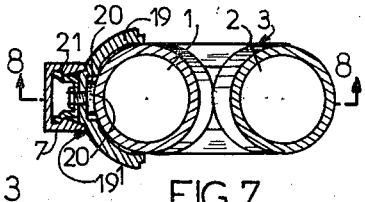
FIG. 7 is a sectional view taken along line 7—7 in FIG. 1.
Figure 2:
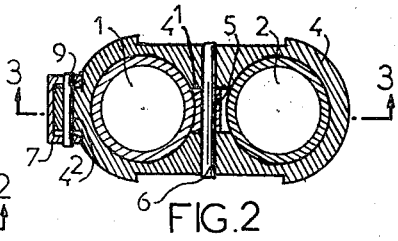
FIG. 2 is a sectional view on a larger scale taken along line 2—2 in FIG. 1.

With reference to FIG. 1 of the drawing, the rear ends of the tubes of gun barrels 1 and 2 are fitted and secured in a mounting 3 of a gun stock, in known manner, the barrels being disposed in parallel relation and extending in free cantilever fashion from mounting 3. The barrels 1 and 2 are connected at their front ends at a spacing that is determined by a double collar 4 having respective bores receiving said tubes. The collar 4 is provided with an axial slot $4^1$ for the longitudinal engagement of a stud 5 integral with the upper tube 1. The fastening of collar 4 in relation to the upper tube 1 is provided by a transverse cotter pin 6 projecting in succession through the collar 4 and the stud 5.

The upper part of the double collar 4 has a boss $4^2$ disposed at the front of the collar and the boss is provided with a longitudinal slot $4^3$ forming a hook which co-operates with a cotter pin 9 secured to the front end of a detachable and interchangeable sight band 7 disposed above the upper barrel tube 1. The band 7 is of U-shape in cross-section.

The rear end of the U-shape band 7 overlaps an axial boss $3^1$ protruding from the front of the mounting 3 and the band 7 is held longitudinally by a transverse cotter pin 8. The double collar 4 is displaced with the elongation of the upper barrel tube 1, the double collar sliding freely on the lower tube 2 and also, by the slot $4^3$ in the collar the double collar slides on the cotter pin 9 providing the connection with the front end of the band 7 which thus remains stationary. As set forth hereafter, the band 7 is supported freely at two points along the length thereof, by a spacer collar E for the barrels, and by a guard 19 secured rearwardly on the upper barrel tube 1.

The spacer collar E for the barrel tubes 1 and 2 is disposed at the front part of the tubes, approximately at the third point of the length thereof. The collar E includes a lower ring 10 with a bore centered freely on the lower tube 2 and a screw-threaded cylindrical journal $10^1$ protruding between tubes 1 and 2, the journal $10^1$ being provided with an axial bore for the free engagement, when the tubes are placed apart manually, of a positioning finger 11 secured vertically to the lower part of the upper barrel tube 1 and serving for coupling the tube 1 with ring 10. It will be noted also that the ring 10 is provided with lateral and parallel clearances $10^2$ and $10^3$ for the overlapping and sliding of vertical legs of an upper open collar 12 of the spacer collar E.

The open collar 12 is engaged freely on the upper tube 1 and is provided symmetrically along its side legs $12^1$, $12^2$ with a horizontal slot $12^3$ the purpose of which is to fittingly receive a projecting knurled wheel 13 threadingly engaging the journal $10^1$ of the ring 10. By rotating the knurled wheel in one direction or the other it is possible to bring the two parts of the collar E closer to one another or further from one another. Therefore, the barrel tubes 1 and 2 can be brought closer or further to one another to take into account any slight distortion for an accurate setting of the line of sight.

It will be seen that the side legs $12^1$–$12^2$ of the upper open collar 12 are provided with inward vertical slots $12^4$ for the free passage and vertical displacement of the projecting ends of cotter pins 14 fitted in a transverse hole drilled at the upper part of ring 10. The cotter pins 14 provide an abutment in the spaced apart direction of the collar and ring in order to prevent the open collar 12 and the ring 10 from being separated in operation, while permitting the relative vertical shifting thereof.

The projecting knurled wheel 13 is provided at the top thereof with recesses $13^1$ disposed in a circular arrangement to co-operate respectively with a positioning ball 15 accommodated within an opening of an outside boss formed on one of the sides of the lateral legs $12^1$–$12^2$ of the upper open collar 12, and urged to the projecting position by a coil spring 16.

It will also be noted that one or both of the lateral clearances $10^2$–$10^3$ on the ring 10 are provided at their bottom with one or more reference marks, such as a colored triangle 17 co-operating with the end of the corresponding side leg $12^1$–$12^2$ so as to be more or less covered in accordance with the adjustment or the spacing of the barrel tubes 1 and 2. With this arrangement, it is possible to see the direction of the adjustment and the magnitude thereof and also the relative longitudinal displacement of the barrel tubes.

The upper part of the open collar 12 is provided with two axial slide slots $12^5$ opening into a lower recess $12^6$ to form a U-shaped recessed section for accommodating a clip 18 having upwardly projecting side legs that co-operate externally, by clamping engagement, with the complementary hollow section of the detachable and interchangeable band 7, the band having downwardly projecting legs having free ends engaging in square grooves $12^7$ in the collar 12.

The band 7 is supported rearwards of collar E by a guard 19 secured axially, by soldering or the like, on the barrel tube 1. The upper part of guard 19 supports by means of screw or nut 20, a clip 21 with projecting side legs that co-operate externally by clampingly engaging with the hollow section of the band 7. The ends of the legs of band 7 abut in grooves $19^1$ provided in the upper surface of guard 19. The band is rigidly connected at the rear end by means of cotter pin 8 as stated previously, and the connection is made with a sighting-block of sectional shape 22 integral with mounting 3.

The advantages of this device are apparent from the description, and the following features are particularly pointed out:

an axial shifting of each barrel, which is entirely free for each barrel irrespective of the position of the other barrel, without any distortion incidence of the band, in combination with the possibility of adjusting the spacing of their free length between the mounting and the remote collar;

the possibility of bringing the free length of the tubes of the barrels closer together or further apart to improve the line of sight while taking into account the radial and longitudinal distortions;

the ease of the adjustment by means solely of the knurled wheel;

a very substantial improvement in ventilation and cooling, which is faster and more efficient along each barrel tube, due to their respective spacing and the absence of a continous fastening of the upper band with the corresponding barrel;

the elimination of a major part of the occurrences resulting from the distortion of light rays adjacent to the heated portions of the weapon (more particularly the barrel band) which interfere with correct aiming when firing in succession;

a construction that is much less open to the wind due to the absence of large solid areas.

The invention is not limited to the specific embodiments nor to the means employed for the various parts thereof that have been particularly disclosed, and all modifications that fall within the bounds of the claims are intended to be embraced by the invention.

What is claimed is:

1. An adjustable coupling apparatus for first and second spaced superposed barrels of a sporting gun, the barrels being secured at the rear ends thereof to a mounting of the gun and projecting freely forwards therefrom, said apparatus comprising holding means at the front ends of the barrels and fixed to one of the barrels for holding said barrels in fixed transversely spaced relation while permitting relative axial movement therebetween, collar means engaging said barrels at an intermediate location along the lengths thereof for transverse adjustment of the spacing therebetween, and a detachable and interchangeable sight band disposed above the upper one of the barrels and secured to said mounting, said sight band being slidably mounted on said holding means to permit slidable movement of said holding means and said one barrel to which it is fixed while said band remains stationary.

2. An adjustable coupling apparatus as claimed in claim 1 wherein said holding means comprises a double collar having two axial bores each slidably receiving a respective barrel, and means for securing the upper one of the barrels to said double collar.

3. An adjustable coupling apparatus as claimed in claim 2 wherein said collar means comprises a spacer collar including a lower ring slidably engaging the lower of the barrels, an open upper collar slidably engaging the upper of the barrels, said ring and open collar being slidably engaged for relative transverse movement, and means including a rotatable wheel for adjusting the transverse spacing of the collar and ring and the barrels engaged thereby.

4. An adjustable coupling apparatus as claimed in claim 3 wherein said sight band is slidable on said double collar to allow said double collar to displace together with said upper barrel relative to said sight band and the lower of the barrels.

5. An adjustable coupling apparatus as claimed in claim 4 wherein the upper barrel includes an integral stud, said double collar having an axial slot slidably receiving said stud, said means for securing the upper barrel to said double collar comprising pin means engaging said stud and double barrel, and a boss on said double collar having a longitudinal opening defining a hook, and second pin means carried by said sight band and slidably received by said hook.

6. An adjustable coupling apparatus as claimed in claim 3 comprising a hollow threaded journal on said lower ring extending upwardly towards the upper barrel, a positioning finger integral with said upper barrel and slidably engaged within said journal, said upper collar including downwardly projecting legs straddling the lower ring, said legs having slots receiving said rotatable wheel, said rotatable wheel being threadably engaged on said journal and axially retained in said slots such that rotation of said wheel in opposite directions produces relative transverse displacement of said barrels towards and away from one another.

7. An adjustable coupling apparatus as claimed in claim 6 comprising transverse pin means slidably holding the ring and upper collar for relative transverse movement and constituting an abutment preventiong separation of the ring and upper collar.

8. An adjustable coupling apparatus as claimed in claim 6 wherein said rotatable wheel has a circular arrangement of recesses in one face thereof, and a resiliently biassed positioning ball supported in an opening provided in one of said legs of the upper collar for engaging the recesses in said wheel as the latter is rotated.

9. An adjustable coupling apparatus as claimed in claim 6 wherein said ring has side faces engaging said legs of the upper collar, and reference marking means on at least one of said side faces for providing visual display of the spacing and adjustment of said barrels both transversely and longitudinally.

10. An adjustable coupling apparatus as claimed in claim 6 wherein said upper collar has two spaced axial side slots and a lower recess into which said slots open to form a U-shape transverse section, said collar means further comprising a clip engaged in said slots and recess and including upwardly projecting side legs clampingly engaging said sight band.

11. An adjustable coupling apparatus as claimed in claim 6 comprising a guard fixed to the upper of the barrels at a location between the collar means and the mounting, and clip means secured to said guard and clampingly engaging said sight band.

12. An adjustable coupling apparatus as claimed in claim 11 wherein said sight band includes downwardly projecting legs respectively engaging said boss of said double collar, said upper collar and said clip means, said guard, said upper collar, and said double collar having slots for receiving the ends of said legs of said sight band.

* * * * *